United States Patent [19]

Tolnar, Jr.

[11] 4,012,098

[45] Mar. 15, 1977

[54] ELECTRICAL CONNECTOR

[75] Inventor: Emil J. Tolnar, Jr., Warren, Ohio

[73] Assignee: General Motors Corporation, Detroit, Mich.

[22] Filed: July 2, 1976

[21] Appl. No.: 702,216

[52] U.S. Cl. ..... 339/61 R; 339/91 R

[51] Int. Cl.[2] ..... H01R 13/54

[58] Field of Search ..... 339/61 R, 61 C, 61 L, 339/61 M, 91 R, 195 A, 196 A

[56] References Cited

UNITED STATES PATENTS

| | | | |
|---|---|---|---|
| 2,210,625 | 8/1940 | Kuhlman | 339/61 R |
| 2,307,592 | 1/1943 | Kuhlman | 339/61 R |
| 2,499,825 | 3/1950 | Havlicek | 339/61 R |
| 3,281,754 | 10/1966 | Cadwallader | 339/61 R |

*Primary Examiner*—Roy Lake
*Assistant Examiner*—Mark S. Bicks
*Attorney, Agent, or Firm*—F. J. Fodale

[57] ABSTRACT

A unitary connector body of molded dielectric material has a pair of elongated hollow members which house a pair of female electrical terminals matable with a pair of laterally spaced blade-like male terminals carried by another electrical device. A transverse bridge connects the intermediate portions of the elongated members in a manner to provide torsionally resilient hinge means whereby the forward portions of the elongated members move laterally away from each other responsive to movement of the rearward portions toward each other and vice-versa. The forward portions are generally C-shaped in lateral section and a longitudinal center piece extends forwardly from the bridge to guide the male terminals into the forward C-shaped portions. The forward portions have rearwardly facing shoulders which cooperate with lateral shoulders of the pair of male terminals to lock the connector body in coupled engagement. The connector body is unlocked and disconnected by squeezing the rearward portions of the elongated members and withdrawing the connector body longitudinally from the male terminals.

3 Claims, 5 Drawing Figures

ELECTRICAL CONNECTOR

This invention relates generally to electrical connectors and more specifically to electrical connectors having a unitary connector body of molded dielectric material provided with means for locking the connector body in a coupled position where terminals housed in the connector body are mated with terminals of another electrical device.

A very common and conventional lock arrangement comprises flexible lock arms on one connector body engaging lock ramps on a mating connector body. While such arrangements are generally satisfactory from an assembly standpoint, it is often difficult to unlock and disconnect the connector bodies especially when the connector bodies are located in a crowded environment.

The object of this invention is to provide a lockable connector body which is easily unlocked and disconnected even in a crowded environment.

Another object of this invention is to provide a connector body which is locked to a pair of terminals carried by another electrical device with a simple push-on motion and which is unlocked and disconnected therefrom simply by squeezing the rear portions of the connector body and withdrawing the connector body longitudinally.

Still another object of this invention is to provide a connector body of the above noted type which includes means for aligning and guiding the connector body during assembly to the terminals of the other electrical device.

Figure 1:
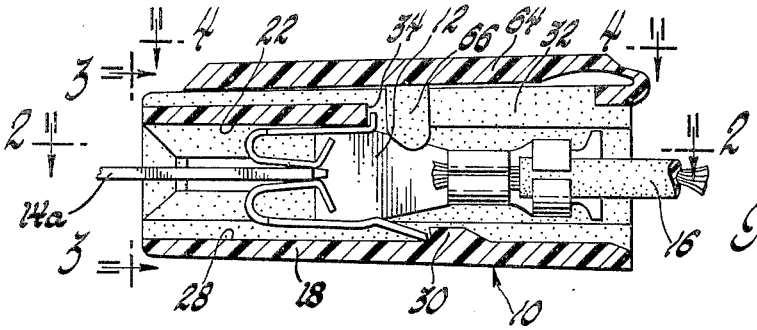
Figure 2:
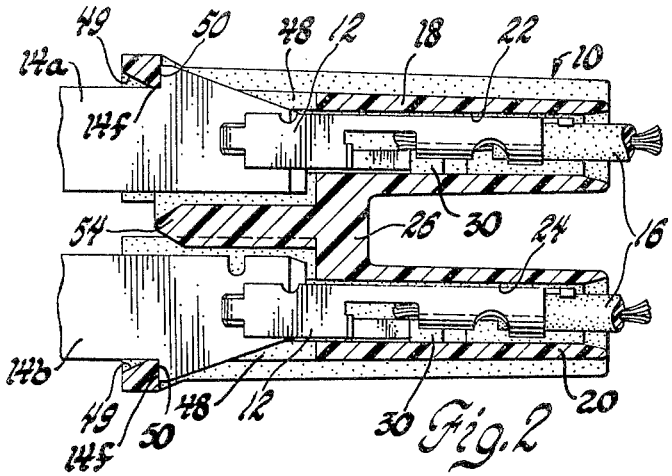
Figure 3:
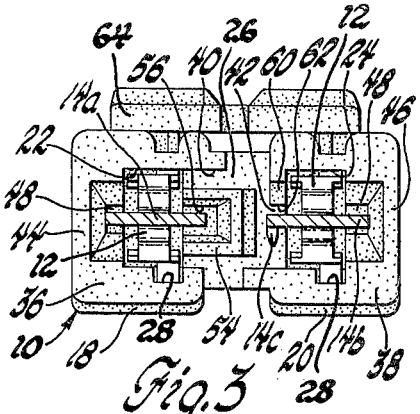
Figure 4:
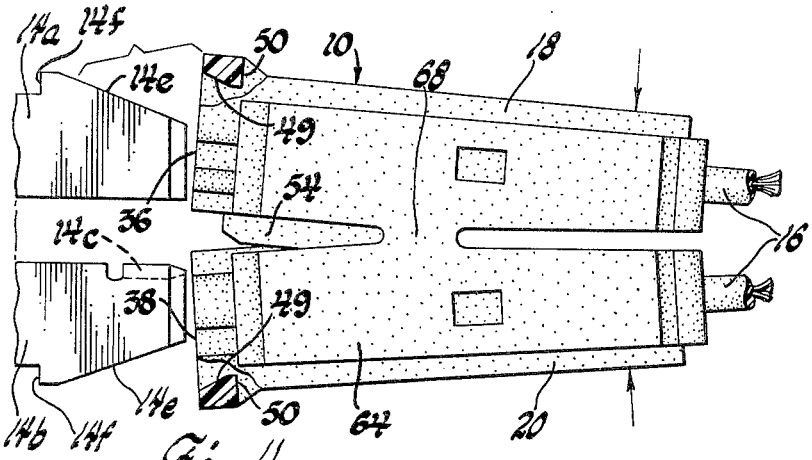
Figure 5:
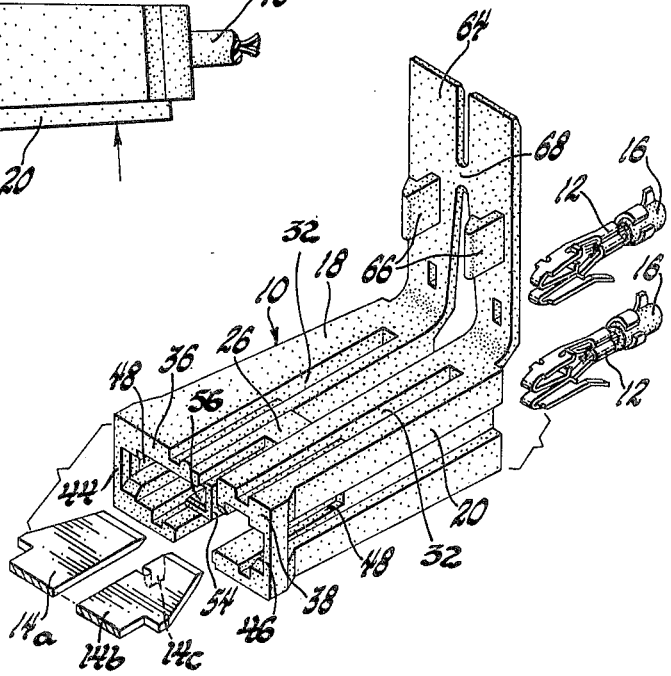

Other objects and features of the invention will become apparent to those skilled in the art as the disclosure is made in the following detailed description of a preferred embodiment of the invention as illustrated in the accompanying sheet of drawing in which:

FIG. 1 is a longitudinal section through an electrical connector in accordance with this invention, FIG. 2 is a section taken substantially along the line 2—2 of FIG. 1 looking in the direction of the arrows, FIG. 3 is a front view of the electrical connector taken along the line 3—3 of FIG. 1 looking in the direction of the arrows, FIG. 4 is a top view of the electrical connector of FIGS. 1 through 3 showing the electrical connector being disconnected from a pair of blade-like male electrical terminals, FIG. 5 is an exploded perspective view of the electrical connector shown in FIGS. 1 through 4.

Referring now to the drawing there is illustrated a connector body 10 for electrically connecting a pair of female electrical terminals 12 to a pair of laterally spaced substantially coplanar blade-like male electrical terminals **14*a* and 14*b*. The female terminals 12 are crimped onto the end of lead wires 16 in a conventional manner and are of the type disclosed in U.S. Pat. No. 3,267,410 granted to Donald G. Baer et al. on Aug. 16, 1966 and assigned to the assignee of this invention. The male electrical terminals 14*a* and 14*b* are laterally spaced and substantially coplanar in a fixed spatial relationship established by an associated electrical device (not shown). The terminals 14*a* and 14*b* have substantially flat portions and are identical except that the terminal 14 may include a perpendicular flange 14*c* for polarizing as will hereinafter more fully appear. Each of the terminals 14*a* and 14*b* has a lateral wing on the outboard side which provides a ramp 14*e* leading to a lateral latch shoulder 14*f***.

The connector body 10 is molded from dielectric material into a unitary construction comprising two elongated hollow or tubular members 18 and 20 defining open ended cavities 22 and 24 each of which receives one of the female terminals 12. The tubular members 18 and 20 are generally rectangular in lateral cross section and are joined at their respective mid-portions by a lateral bridge 26 which normally laterally spaces the members 18 and 20 from each other in a substantially parallel relationship. The respective bottom walls of the members 18 and 20 defining the cavities 22 and 24 each have a longitudinal slot 28 which includes a latch shoulder 30. The respective top walls of the members defining the cavities each have a longitudinal through slot 32 in the rearward portion thereof which forms a stop shoulder 34. The shoulders 30 and 34 cooperate with the female terminals 12 to locate and retain the same in the respective cavities as best illustrated in FIG. 1.

The respective forward end portions 36 and 38 of the members 18 and 20 are C-shaped in transverse cross section forming respective side openings 40 and 42 which extend rearwardly to the forward face of the bridge 26 which provides a forward stop for the male terminals **14*a* and 14*b*. The respective outer side walls 44 and 46 of the forward portions each have an inwardly facing longitudinal slot 48 which includes a rearwardly facing latch shoulder 50 at the forward end. As shown in the drawings, the slots 48 extend through the side walls aft of the latch shoulders 50 up to approximately the plane of the forward face of the bridge 26.**

As best seen in FIG. 2, a longitudinal center piece 54 extends forwardly from the bridge 26 in cantilever fashion. The center piece 54 is U-shaped in lateral cross section defining a longitudinal slot 56 which is aligned with the longitudinal slot 48 of the member 18. The center piece 54 is closer to the member 18 and is partially disposed in the side opening 40 as best seen in FIG. 3. The center piece 54 helps guide the flat male terminal **14*a* into the cavity 22 during assembly and also prevents receipt of the flanged terminal 14*b* thus assuring proper electrical polarity. The forward portion of the member 20 has a vertical flange 60 which reduces the height of the side opening 42 to provide an upper guide surface 62 for the terminal 14*b* which is coplanar with the upper surfaces of the slots 48 and 56. The guide surface 62 helps guide terminal 14*b* during assembly while the unblocked lower portion of the side opening 42 permits receipt of the polarizing flange 14*c***.

The slots 48 and 56 all have chamfered lead-ins in both direction. The lateral chamfers 49 leading into the slots 48 cooperate with the ramps **14*e* of the male terminals during assembly. More specifically, as the connector body 10 is pushed onto the male terminals the ramps 14*e* spread the forward portions of the members 18 and 20 apart until the latch shoulders 14*f* pass the shoulders 50 whereupon the shoulders 50 snap into place behind the latch shoulders 14*f***.

The front face of the center piece 54 is illustrated as spaced slightly rearwardly of the front face of the connector body 10 at a position approximately coplanar with the shoulders 50. This position of the front face, however, is not critical and can be adjusted in either direction.

The members 18 and 20 are interconnected solely by the lateral bridge 26 joining their mid-portions. Each end of the bridge 26 is connected to a side wall of the member 18 or 20 in such a manner to provide a torsionally resilient hinge means. The members 18 and 20 being relatively stiff act as levers and consequently the forward ends of the members 18 and 20 move laterally away from each other when the rearward ends are squeezed together with manually applied forces such as are indicated by the arrows in FIG. 4.

An H-shaped flap 64 is connected to the rear end of each of the members 18 and 20 by a flexible hinge so that the flap 64 is movable between the open position shown in FIG. 5 and the closed position shown in FIG. 1 where two perpendicular teeth 66 on the flap 64 are disposed in the respective cavities 22 and 24 behind an upper lock tab of the respective female terminals 12 therein. The perpendicular teeth 66 are hook-shaped and engage inside surfaces of the top walls to lock the flap 64 in the closed position shown in FIG. 1. The cross web 68 joining the legs of the H-shaped flap 64 is relatively flexible and overlies the lateral bridge 26 when the flap 64 is in the closed position so that the action of the flap legs corresponds to that of the members 18 and 20 when the connector body is connected to or disconnected from the male terminals 14*a* and 14*b*.

Referring now to the exploded view of FIG. 5 the various parts are assembled and connected in the following manner. The female terminals 12 crimped to the ends of the lead wires 16 are first inserted into the cavities 22 and 24 from the rearward open ends until the female terminals are located and latched therein by the shoulders 30 and 34. The flap 64 is then moved to the closed position shown in FIG. 1 where the teeth 66 are disposed behind the upper lock tabs of the female terminals to provide a back-up lock secondary to that provided by the lower latch tongues and shoulders 30. The connector body 10 with the flap 64 closed and the female terminals 12 secured in the cavities 22 and 24 is then mechanically connected to the male terminals 14*a* and 14*b* simply by pushing the connector body 10 onto the male terminals. During assembly the center piece 54 properly aligns the connector body 10 with respect to the male terminals 14*a* and 14*b* and prevents any possibility of an improper connection such as a single male terminal cocked at an angle being partially received in both cavities. As the connector body 10 is pushed onto the male terminals 14*a* and 14*b*, the forward portions of the members 18 and 20 are spread by the terminal ramps 14*e* engaging the lateral chamfers 49 until the shoulders 50 of the connector body 10 snap into place behind the terminal latch shoulders 14*f*. The longitudinal slots 48 and 56 and guide surface 62 guides the male terminals 14*a* and 14*b* into a frictional biased engagement between the cantilevered U-shaped spring tongues of the female terminals 12. The male and female terminals are engaged with each other solely by frictional bias and there is no mechanical connection or latching therebetween.

The connector body 10 is unlocked and disconnected from the male terminals 14*a* and 14*b* simply by squeezing the rear portions of the members 18 and 20 together manually. This causes the members 18 and 20 to pivot on the torsionally resilient hinge means at the ends of the bridge 26 with the result that the shoulders 50 at the forward ends of the members 18 and 20 are moved apart in the lateral direction a sufficient amount to clear the terminal latch shoulders 14*f*. The connector body 10 is then simply withdrawn longitudinally.

We wish it to be understood that we do not desire to be limited to the exact details of construction shown and described, for obvious modifications will occur to a person skilled in the art.

What is claimed is:

1. A unitary connector body of molded dielectric material for connection to a pair of laterally spaced electrical terminals each having a latch shoulder extending laterally in a direction away from the other terminal comprising:

a first elongated hollow member for housing an electrical terminal matable with one of said first mentioned terminals and a second elongated hollow member for housing an electrical terminal matable with another of said first mentioned terminals, said members each having a forward portion for receiving one of said first mentioned terminals, an intermediate portion and a rearward portion, bridge means interconnecting the intermediate portions of said members and normally laterally spacing said members in generally parallel relationship, said bridge means including hinge means and said members being relatively rigid whereby said forward portions move laterally away from each other responsive to movement of said rearward portions toward each other, said forward portions being generally C-shaped in lateral section defining side openings toward the bridge means for permitting lateral movement of said forward portions away from each other when a pair of laterally spaced terminals in fixed spatial relationship are disposed in said forward portions, and each of said forward portions having a rearwardly facing shoulder which is at a forward end thereof and opposite its side opening for locking engagement with respective laterally projecting latch shoulders of a pair of electrical terminals whereby the connector body is adapted to be detachably connected to a pair of laterally spaced electrical terminals in fixed spatial relationship.

2. A unitary connector body of molded dielectric material for detachable mechanical connection to a pair of laterally spaced substantially coplanar blade-like electrical terminals each having a latch shoulder extending laterally in a direction away from the other terminal comprising:

a first elongated hollow member for carrying an electrical terminal matable with one of said first mentioned terminals and a second elongated hollow member for carrying an electrical terminal matable with another of said first mentioned terminals, said members each having a forward portion for receiving one of said first mentioned terminals, an intermediate portion and a rearward portion, an integral lateral bridge connecting the intermediate portions of said members and normally laterally spacing said members in generally parallel relationship, said bridge including hinge means and said members being relatively rigid whereby said forward portions move laterally away from each other responsive to movement of said rearward portions toward each other, said forward portions being generally C-shaped in lateral section defining side openings toward the bridge for permitting lateral movement of said forward portions away from each other when a pair of laterally spaced blade-like electrical terminals in fixed spatial relationship are disposed in said forward portions, each of said forward portions having a longitudinal slot in a side wall opposite its respective side opening for receiving an edge portion of a blade-like electrical terminal when disposed therein, each of said forward portions further having a rearwardly facing shoulder which is at a forward end thereof and disposed in said longitudinal slot for latching engagement with a laterally projecting latch shoulder of a blade-like electrical terminal when such is disposed therein whereby the connector body is adapted to be detachably connected to a pair of laterally spaced electrical terminals in fixed spatial relationship, an integral centerpiece extending forwardly from said bridge in cantilevered fashion, said centerpiece having portions disposed in the side opening of one of said members and defining a longitudinal slot aligned with the longitudinal slot in said one member, and flange means defining a guide surface disposed in the side opening of the other of said members and aligned with a surface of the longitudinal slot in said other member.

3. A unitary connector body of molded dielectric material for detachable mechanical connection to a pair of laterally spaced substantially coplanar blade-like electrical terminals each having a latch shoulder extending laterally in a direction away from the other terminal comprising:

a first elongated hollow member of generally rectangular cross section for carrying a female electrical terminal matable with one of said first mentioned terminals and a second elongated hollow member of generally rectangular cross section for carrying a female electrical terminal matable with another of said first mentioned terminals, said members each having a forward portion for receiving one of said first mentioned terminals, an intermediate portion and a rearward portion, an integral lateral bridge connecting the intermediate portions of said members and normally laterally spacing said members in generally parallel relationship, said bridge including hinge means at each end connected to a side wall of one of said intermediate portions and said members being relatively rigid whereby said forward portions move laterally away from each other responsive to movement of said rearward portions toward each other, said forward portions being generally C-shaped in lateral cross section defining side openings toward the bridge for permitting lateral movement of said forward portions away from each other when a pair of laterally spaced blade-like electrical terminals in fixed spatial relationship are disposed in said forward portions, each of said forward portions having a longitudinal slot in a side wall opposite its respective side opening for receiving an edge portion of a blade-like electrical terminal when disposed therein, each of said forward portions further having a rearwardly facing shoulder which is at a forward end thereof and disposed in said longitudinal slot for latching engagement with a laterally projecting latch shoulder of a blade-like electrical terminal when such is disposed therein whereby the connector body is adapted to be detachably connected to a pair of laterally spaced electrical terminals in fixed spatial relationship, and an integral longitudinal centerpiece extending forwardly from said bridge in cantilevered fashion, said centerpiece being U-shaped in lateral cross section and defining a longitudinal slot aligned with the longitudinal slot of one of said members, said centerpiece having portions disposed in the side opening of said one member.

* * * * *